US007701313B2

(12) United States Patent
Kim

(10) Patent No.: US 7,701,313 B2
(45) Date of Patent: Apr. 20, 2010

(54) CASE FOR CIRCUIT BREAKER WITH MONOLITHIC DOOR

(75) Inventor: Ki-Young Kim, Chungcheongbuk-Do (KR)

(73) Assignee: LS Industrial Systems Co., Ltd, Seoul (KR)

( * ) Notice: Subject to any disclaimer, the term of this patent is extended or adjusted under 35 U.S.C. 154(b) by 227 days.

(21) Appl. No.: 11/752,542

(22) Filed: May 23, 2007

(65) Prior Publication Data

US 2008/0218297 A1 Sep. 11, 2008

(30) Foreign Application Priority Data

Mar. 8, 2007 (KR) ..... 10-2007-0023212

(51) Int. Cl.
*H01H 9/02* (2006.01)
*H01H 13/04* (2006.01)

(52) U.S. Cl. ..... 335/202; 335/162; 439/248; 439/282; 439/467; 200/168; 220/3.2; 361/627

(58) Field of Classification Search ..... 335/162, 335/202; 439/76.1, 95, 248, 278, 282, 467, 439/620.1, 620.18; 200/168; 220/3.2; 361/627
See application file for complete search history.

(56) References Cited

U.S. PATENT DOCUMENTS

| | | | | |
|---|---|---|---|---|
| 5,578,980 | A * | 11/1996 | Okubo et al. | 335/132 |
| 5,582,520 | A * | 12/1996 | Doudon | 439/106 |
| 6,191,947 | B1 * | 2/2001 | Titus et al. | 361/726 |
| 6,379,196 | B1 * | 4/2002 | Greenberg et al. | 439/801 |
| 6,515,850 | B2 * | 2/2003 | Fournier et al. | 361/627 |
| 6,897,748 | B2 * | 5/2005 | Yamagata et al. | 335/132 |
| 7,319,373 | B2 * | 1/2008 | Zindler | 335/132 |
| 7,414,828 | B2 * | 8/2008 | Birner | 361/624 |
| 2005/0012578 | A1 * | 1/2005 | Afshari et al. | 335/202 |
| 2006/0131145 | A1 | 6/2006 | Suh | |
| 2007/0001791 | A1 * | 1/2007 | Fischer et al. | 335/202 |
| 2007/0236841 | A1 * | 10/2007 | Asano et al. | 361/42 |

FOREIGN PATENT DOCUMENTS

| | | |
|---|---|---|
| CA | 2408336 | 4/1993 |
| DE | 3728796 A1 | 3/1989 |
| EP | 0986136 | 3/2000 |

(Continued)

OTHER PUBLICATIONS

U.S. Appl. No. 11/752,421 to Oh, filed May 23, 2007.

(Continued)

*Primary Examiner*—Elvin G Enad
*Assistant Examiner*—Mohamad A Musleh
(74) *Attorney, Agent, or Firm*—Greenblum & Bernstein P.L.C.

(57) ABSTRACT

In a case for a circuit breaker in which a terminal is simply replaceable or mountable according to a wiring method of the circuit breaker, the case comprises a case which accommodates components for breaking a circuit, a terminal block portion which provides a common platform for plural types of terminals, and a door engaged with the case in monolithic form so that it may be operable to a closed position for closing the case or an opened position for installing a selected terminal of the plural types of terminals.

8 Claims, 15 Drawing Sheets

FOREIGN PATENT DOCUMENTS

| | | | |
|---|---|---|---|
| EP | 1770729 | B1 | 5/2008 |
| FR | 2602948 | A1 | 2/1988 |
| JP | 56-120641 | | 9/1981 |
| JP | 2-111044 | | 9/1990 |
| JP | 6-139911 | | 5/1994 |
| KR | 1020060087344 | | 8/2006 |
| WO | 98 53469 | | 11/1998 |

OTHER PUBLICATIONS

English language Abstract of FR 2602948 A1, Feb. 19, 1988.
English language Abstract of DE 3728796 A1, Mar. 9, 1989.
English language Abstract of JP 6-139911, May 20, 1994.
English language Abstract of KR 1020060087344, Aug. 2, 2006.

* cited by examiner

CASE FOR CIRCUIT BREAKER WITH MONOLITHIC DOOR

RELATED APPLICATION

The present disclosure relates to subject matter contained in priority Korean Application No. 10-2007-0023212, filed on Mar. 8, 2007, which is herein expressly incorporated by reference in its entirety.

BACKGROUND OF THE INVENTION

1. Field of the Invention

The present invention relates to a low voltage circuit breaker which is so-called molded case circuit breaker, and particularly, to a case for a circuit breaker with a monolithic door capable of simply changing a terminal structure according to a wire engaging method.

2. Background of the Invention

In general, a circuit breaker applied to a power system may be provided with a terminal portion for engaging a power source side wire and a electric load side wire. The circuit breaker may have, according to a wire engaging method, an upper engaging-type terminal portion (so-called standard type terminal portion), a rear engaging-type terminal portion, a plug-in type terminal portion and a lug type terminal portion.

A circuit breaker with a structure capable of replacing various terminal portions according to the wire engaging method and a case therefor according to the related art will be described with reference to the accompanying drawings.

First, the related art will be described with reference to FIGS. 1 and 2.

FIG. 1 is a perspective view illustrating a circuit breaker according to the related art and a case therefor, particularly, a partially-cut perspective view illustrating a terminal portion, and FIG. 2 is a view illustrating a circuit breaker according to the related art and a case therefor, particularly, an operational state view illustrating that a terminal block is assembled to or separated from a terminal portion.

Regarding a circuit breaker 1 according to the related art illustrated in FIG. 1, a case therefor may include a lower case 2 and an upper cover 3. A reference numeral 6 designates a terminal block provided at each of front and rear surfaces of the circuit breaker 1 for engaging external wires of power source side and electric load side.

Explaining an operation of mounting (assembling) the terminal block portion 6 to the circuit breaker 1 according to the related art with reference to FIG. 2, an upper engaging-type terminal portion (so-called a standard type terminal portion) is exemplarily shown in FIG. 2. The terminal block portion 6 is inserted into the circuit breaker 1 in a rear direction indicated by an arrow based upon the drawing in a state of having a nut 7 being mounted thereon.

In more detail, rail engaging portions (reference numeral not given) formed by both lateral concave portions between upper and lower plates of the terminal block portion 6 are slid onto mounting rails (reference numeral is not designated) which are installed at the lower case 2 below a terminal portion T of a fixed contactor which is exposed to front and rear surfaces of the circuit breaker 1 and provided on each of three phases, such that the rail engaging portions can be supported by the mounting rails. Accordingly, the terminal block portion 6 is assembled to the circuit breaker 1 of the related art.

Here, terminal block protrusions 6*a* formed on the lower plate of the terminal block portion 6 intensify a contact force between the rail engaging portions of the terminal block portion 6 and the mounting rails at the lower case 2.

An unexplained reference numeral 3 in FIG. 2 designates the upper cover previously described in FIG. 1.

Both in the related art and in the present invention, various types of terminal blocks can be mounted in the circuit breaker, which will be described with reference to FIGS. 3 to 6.

A terminal block shown in FIG. 3 designates a standard type terminal block portion 6-1 which is a terminal block having an upper face (surface) to which an external wire of either a power source or an electric load is engaged. It is characteristic that a nut (refer to the numeral 7 in FIG. 2) is mounted on its upper face.

A terminal block shown in FIG. 4 designates a rear engaging-type terminal block portion 6-2, which is a terminal block in a shape that an external wire of the power source or the electric load is engaged to short rear engaging-type terminal and long rear engaging-type terminal (refer to 6-2*a* and 6-2*b* in FIGS. 8 and 9) each of which is extended downwardly from a terminal block (not shown). Unlike the standard type terminal block portion 6-1, this rear engaging-type terminal block portion 6-2 does not have the nut but has an insertion hole in which an upper hexagonal end portion of the short or long rear engaging-type terminal is inserted.

A terminal block shown in FIG. 5 designates a plug-in type terminal block portion 6-3, which is a terminal block in a shape that an external wire of power source or the electric load is engaged to a plug-in type terminal (not shown and refer to 6-3*a* in FIG. 11) extended downwardly from the terminal block. Unlike the standard type terminal block portion 6-1, this plug-in type terminal block portion 6-3 does not have the nut but has an insertion hole in which an upper hexagonal end portion of a plug-in type terminal is inserted.

A terminal block shown in FIG. 6 designates a lug type terminal block portion 6-4 in a shape that an external wire of the power source or electric load is connected in a lug (refer to the numeral 6-4*a* in FIG. 13). It is characteristic that the upper surface of the terminal block portion 6-4 is wide and flat suitable for the installation of a terminal portion of a fixed contactor (refer to T in FIG. 2).

FIG. 7 is a view illustrating a circuit breaker according to the related art and a case therefor, particularly, a state view illustrating an operation that an external wire is connected to a terminal portion having a standard type terminal block mounted, explanation of which will be given as follows.

The operation of mounting the standard type terminal block can be understood by the description made with reference to FIG. 2.

After mounting the standard type terminal block, the following operation is performed such that external wires of the power source or electric load (in detail, six wires in all including three power source side three-phase wires and three electric load side three-phase wires) are engaged to terminal portions exposed to front and rear surfaces of the lower case 2 of the circuit breaker.

That is, as shown in the drawing, a wire terminal W1 of an external wire W is placed on an exposed terminal portion (reference numeral not given) of a fixed contactor.

A coupling screw S is inserted into (passed through) the wire terminal W1 to be coupled (engaged) to a screw engaging hole (not shown) formed in the terminal portion of the fixed contactor.

Accordingly, the external wire W can be electrically connected to the fixed contactor terminal portion so as to complete the wire connection.

With reference to FIGS. 8 to 10, explanation will be made of a rear connecting-type terminal block according to the related art and the construction of a case for a circuit breaker having the rear connecting-type terminal block, and an operation of mounting the rear connecting-type terminal block according to the related art to the case for the circuit breaker.

Description will be given of an operation of first removing a standard type terminal block having mounted and mounting a rear engaging-type terminal block with reference to FIG. 10 as follows.

FIG. 10 is a view illustrating a circuit breaker according to the related art and a case therefor, particularly, a perspective view shown from a lower side of the circuit breaker with an inclination angle which illustrates an operation of removing is a standard type terminal block and mounting a rear connecting-type terminal block and a rear connecting-type terminal.

First, as illustrated in FIG. 10, a standard type terminal block portion 6-1 is removed in a direction indicated by an arrow.

The rear engaging-type terminal block portion 6-2 is mounted where the removed standard type terminal block portion 6-1 has been disposed.

An upper end hexagonal engaging portion either of a short rear connecting-type terminal 6-2*a* or a long rear connecting-type terminal 6-2*b* is upwardly inserted from a lower side of the rear connecting-type terminal block portion 6-2.

The upper end hexagonal connecting portion of the rear connecting-type terminal 6-2*a* or 6-2*b* is rotated for insertion such that the upper end hexagonal connecting portion can be accurately connected with an inner hexagonal connecting hole of the rear connecting-type terminal block portion 6-2. Accordingly, the rear connecting-type terminal block portion 6-2 is connected to the rear connecting-type terminal 6-2*a* or 6-2*b*.

A coupling screw S is inserted into a screw engaging hole (not shown) of the terminal portion of the fixed contactor and a female screw hole (not shown) formed in an upper end portion (head portion) of the rear connecting-type terminal 6-2*a* or 6-2*b* so as to be coupled thereto.

Accordingly, the connecting between the rear connecting-type terminal 6-2*a* or 6-2*b* and the rear connecting-type terminal block portion 6-2 can firmly be maintained.

For additional reference, external wires may be connected to the rear connecting-type terminal 6-2*a* or 6-2*b* by a method for inserting the wires through a wire connecting hole formed in a lower end portion of the rear connecting-type terminal 6-2*a* or 6-2*b*.

In another connecting method, a busbar-type wire is placed on the lower end portion of the rear connecting-type terminal 6-2*a* or 6-2*b*. A bolt is inserted through both the wire connecting hole and the busbar-type wire to be fixed by a nut, thereby engaging the wire to the terminal.

With reference to FIGS. 11 and 12, the following description will be given of constructions of a plug-in type terminal block and a case for a circuit breaker having the same according to the related art, and an operation of mounting the plug-in type terminal block at the case for the circuit breaker according to the related art.

An operation of first removing a standard type terminal block having mounted and mounting a plug-in type terminal block will be described with reference to FIG. 11.

FIG. 11 is a view illustrating a circuit breaker and a case therefor according to the related art, particularly, a perspective view shown from a lower side with an inclination angle which illustrates an operation of removing a standard type terminal block and mounting a plug-in type terminal block and a plug-in type terminal.

First, as illustrated in FIG. 11, the standard type terminal block portion 6-1 is removed in a direction indicated by an arrow.

The plug-in type terminal block portion 6-3 is mounted where the removed standard type terminal block portion 6-1 has been disposed.

An upper end hexagonal connecting portion of the plug-in type terminal 6-3*a* is upwardly inserted from a lower side of the plug-in type terminal block portion 6-3. Accordingly the plug-in type terminal 6-3*a* is connected to the plug-in type terminal block portion 6-3.

A coupling screw S is inserted into a screw engaging hole (not shown) of the terminal portion of the fixed contactor and a female screw hole (not shown) formed in an upper end portion (head portion) of the plug-in type terminal 6-3*a* so as to be coupled thereto.

Accordingly, the connecting between the plug-in type terminal 6-3*a* and the plug-in type terminal block portion 6-3 can firmly be maintained.

Description will be given with reference to FIG. 12 of an operation of engaging a circuit breaker having a plug-in type terminal block and a plug-in type terminal according to the related art and its case to a plug-in connecting base as follows.

Referring to FIG. 12, a plug-in connecting base B may include plug-in insertion holes B2 for engaging plug-in terminals of the circuit breaker having a plug-in type terminal, and a plurality of engaging terminals B1 disposed at front and rear surfaces for connecting external wires of either a power source side or a electric load side.

The plug-in connecting base B as illustrated in FIG. 12 may be a base to which not only the case for the circuit breaker having the plug-in type terminal according to the related art but also a case for a circuit breaker having a plug-in type terminal according to the present invention can be engaged.

An operation of connecting the plug-in terminal of the circuit breaker having a plug-in type terminal to the plug-in connecting base B can be done by pressing and inserting the plug-in terminal of the circuit breaker into the plug-in insertion hole B2 from an upper side of the plug-in connecting base B.

An operation of connecting a lug-type terminal block and a lug according to the related art will be explained with reference to FIG. 13 as follows.

Explaining that a lug-type terminal block portion 6-4 is assembled to a circuit breaker 1 according to the related art with reference to FIG. 13, first, the lug-type terminal block portion 6-4 is inserted into the circuit breaker 1 in a direction to a rear surface side based upon the drawing.

In more detail, rail engaging portions (reference numeral not given) formed by both concave portions between upper and lower plates of the lug-type terminal block portion 6-4 are installed onto mounting rails (reference numeral not given) which are installed at the lower case 2 below a terminal portion T of a fixed contactor, each of which is exposed to front and rear surfaces of the circuit breaker 1 and provided on each of three phases, such that the rail engaging portions can be supported by the mounting rails. Accordingly, the lug-type terminal block portion 6-4 is assembled to the circuit breaker 1 of the related art.

The lug 6-4*a* is inserted in a direction to a rear surface side based upon the drawing such that it can be positioned on the terminal portion T of the fixed contactor.

Regarding the case for the terminal structure changeable circuit breaker the according to the related art which is configured and mounted as mentioned above, from the perspective of manufacturers of the circuit breakers or installation operators of the circuit breakers, the terminal blocks should be provided according to their types to be suitable for each wiring method. Accordingly, they should keep sufficient amount of the terminal blocks according to their types in order to supply them when required.

In addition, in the case for the terminal structure changeable circuit breaker the according to the related art, each type of terminal block has a similar structure, which make it difficult for those who have not instructed or have no experience of classification to accurately classify and use the terminal blocks.

In the case for the terminal structure changeable circuit breaker the according to the related art, each type of terminal block has a very small size with a horizontal or vertical length of 1 to 3 centimeters. Also, these tiny components are fabricated separately from the case for the circuit breaker to be thereafter assembled thereto. Accordingly, it is easy to lose the terminal blocks.

Therefore, the manufacturers or installation operators of the circuit breakers need to make personal, temporal or physical efforts for preventing the loss.

Furthermore, a separation preventing structure between a terminal block and a case, for example, a separation preventing protrusion with strong intensity for preventing the separation of the terminal block while being used is generally configured. Accordingly, if the terminal block is required to be replaced while being used, when separating the terminal block to be replaced by an excessive force or by using a certain device, the terminal block or the case for the circuit breaker may be damaged.

In addition, if the separation preventing structure between the terminal block and the case is changed into a structure that can easily be separated by weak outer force, due to the difficulty of the replacement, the terminal block may easily frequently be separated from the case.

SUMMARY OF THE INVENTION

Therefore, in order to solve the drawbacks of the related art, an object of the present invention is to provide a case for a circuit breaker with a terminal structure changeable monolithic door by which manufacturers or installation operators of the circuit breaker do not have to keep various types of terminal blocks according to wiring methods and to make an effort to prevent the loss of the terminal blocks, can prevent the separation of the terminal blocks from the case, and structure and method for changing a wiring method can be simplified.

To achieve these and other advantages and in accordance with the purpose of the present invention, as embodied and broadly described herein, there is provided a case for a circuit breaker with a terminal structure changeable monolithic door comprising: a case which accommodates components for breaking a circuit; a terminal block which provides a common platform for plural types of terminals; and a door engaged with the case in monolithic form so that it may be operable to a closed position for closing the case or an opened position for installing a selected terminal of the plural types of terminals.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 3 to 6 are perspective views illustrating various types of terminal blocks to be commonly applicable to the related art and the present invention, wherein FIG. 3 is a perspective view of a standard type terminal block, FIG. 4 is a perspective view of a rear engaging-type terminal block, FIG. 5 is a perspective view of a plug-in type terminal block, and FIG. 6 is a perspective view of a lug type terminal block;

DETAILED DESCRIPTION OF THE INVENTION

Description will now be given in detail of a case for a circuit breaker having a monolithic door according to the present invention, with reference to the accompanying drawings.

A configuration of a case for a circuit breaker having a terminal structure changeable monolithic door according to the present invention and a door opening/closing operation will be described with reference to FIGS. 14 to 17 as follows.

Figure 14:
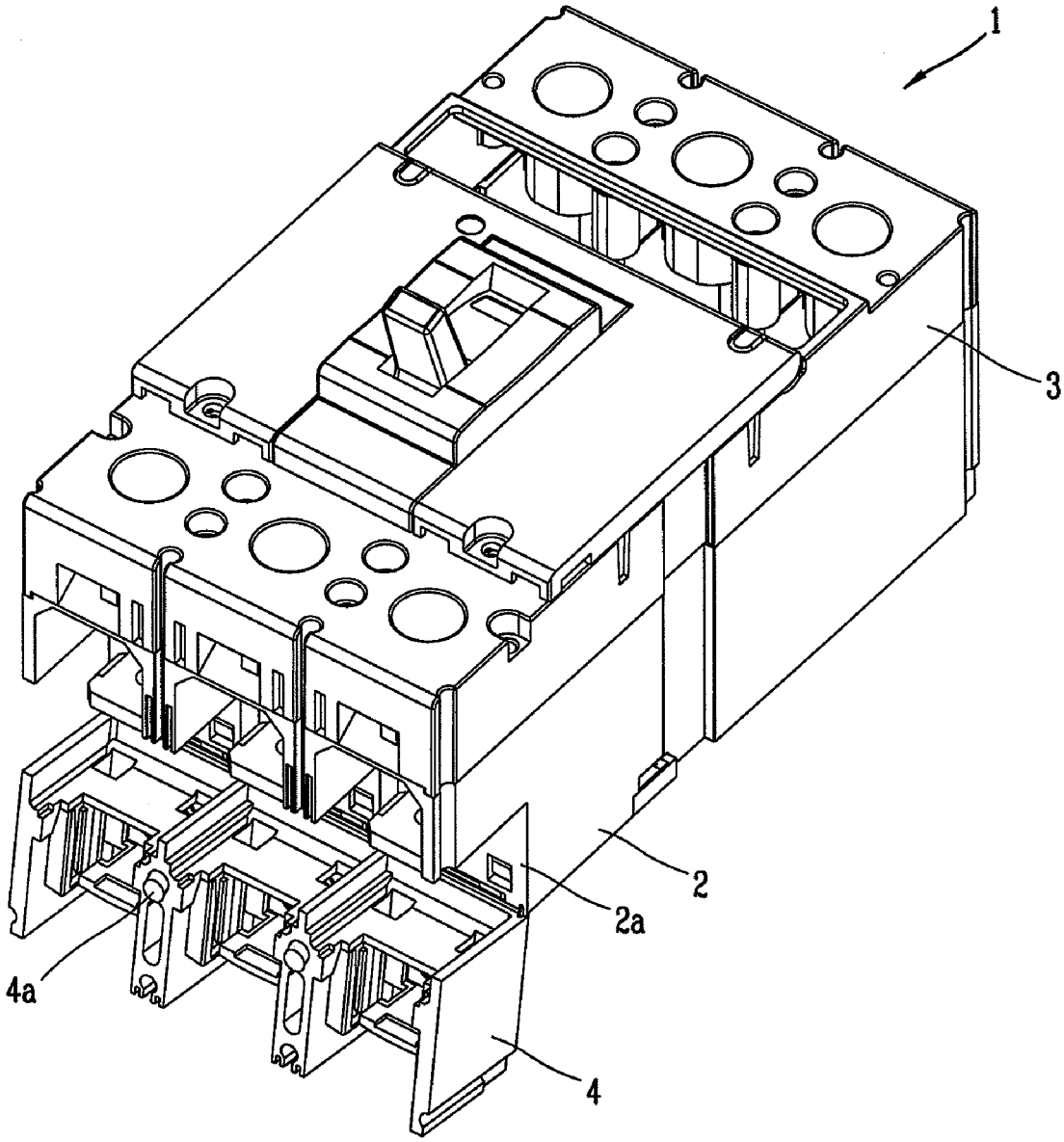
FIG. 14 is a perspective view illustrating a case for a circuit breaker having its door completely opened according to present invention.
Figure 15:
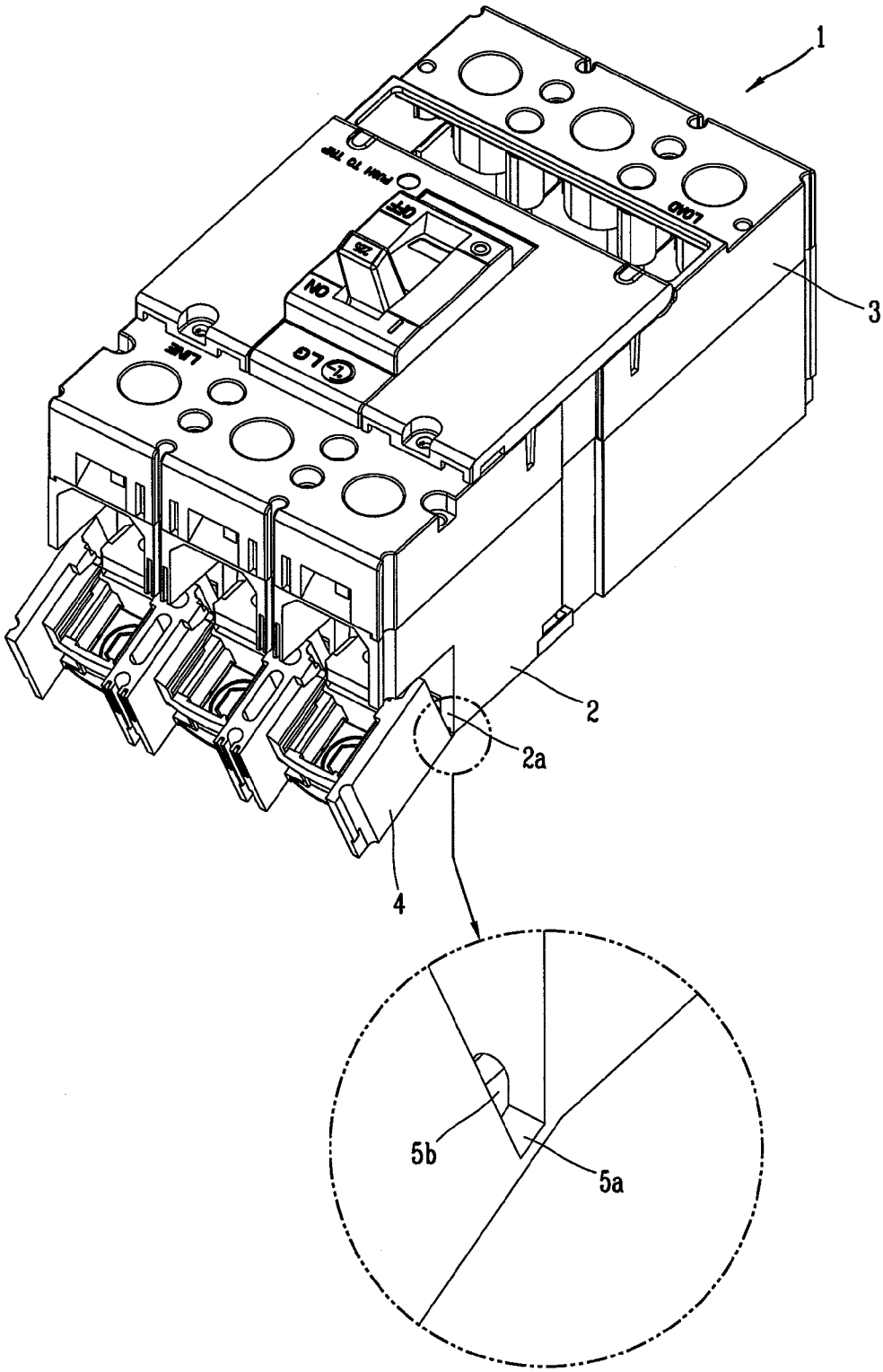
FIG. 15 is a perspective view illustrating a case for a circuit breaker having a door half-opened or half-closed, and the view in the circle is an enlarged view of a engaging portion between the door and a lower case for the circuit breaker.
Figure 16:
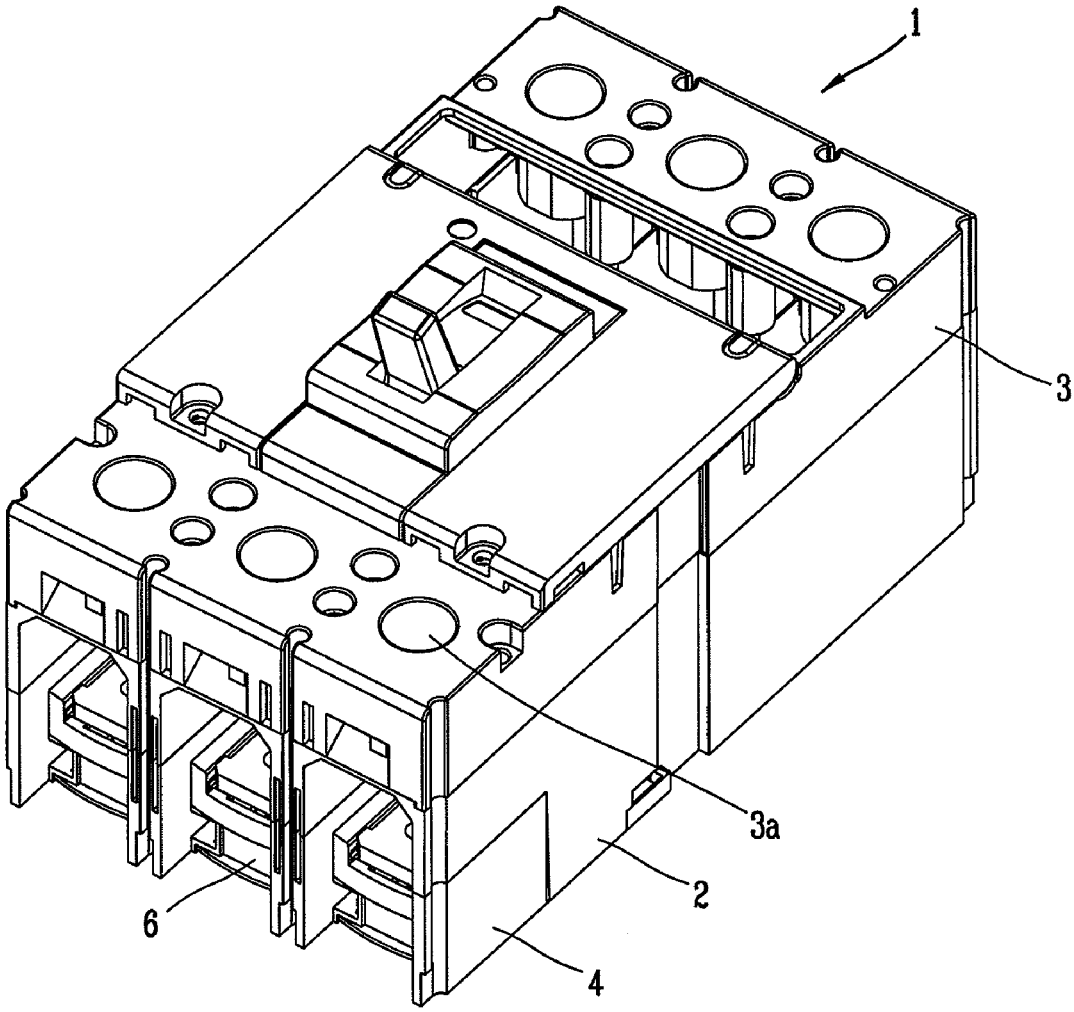
FIG. 16 is a perspective view illustrating a case for a circuit breaker having a door completely closed according to the present invention.
Figure 17:
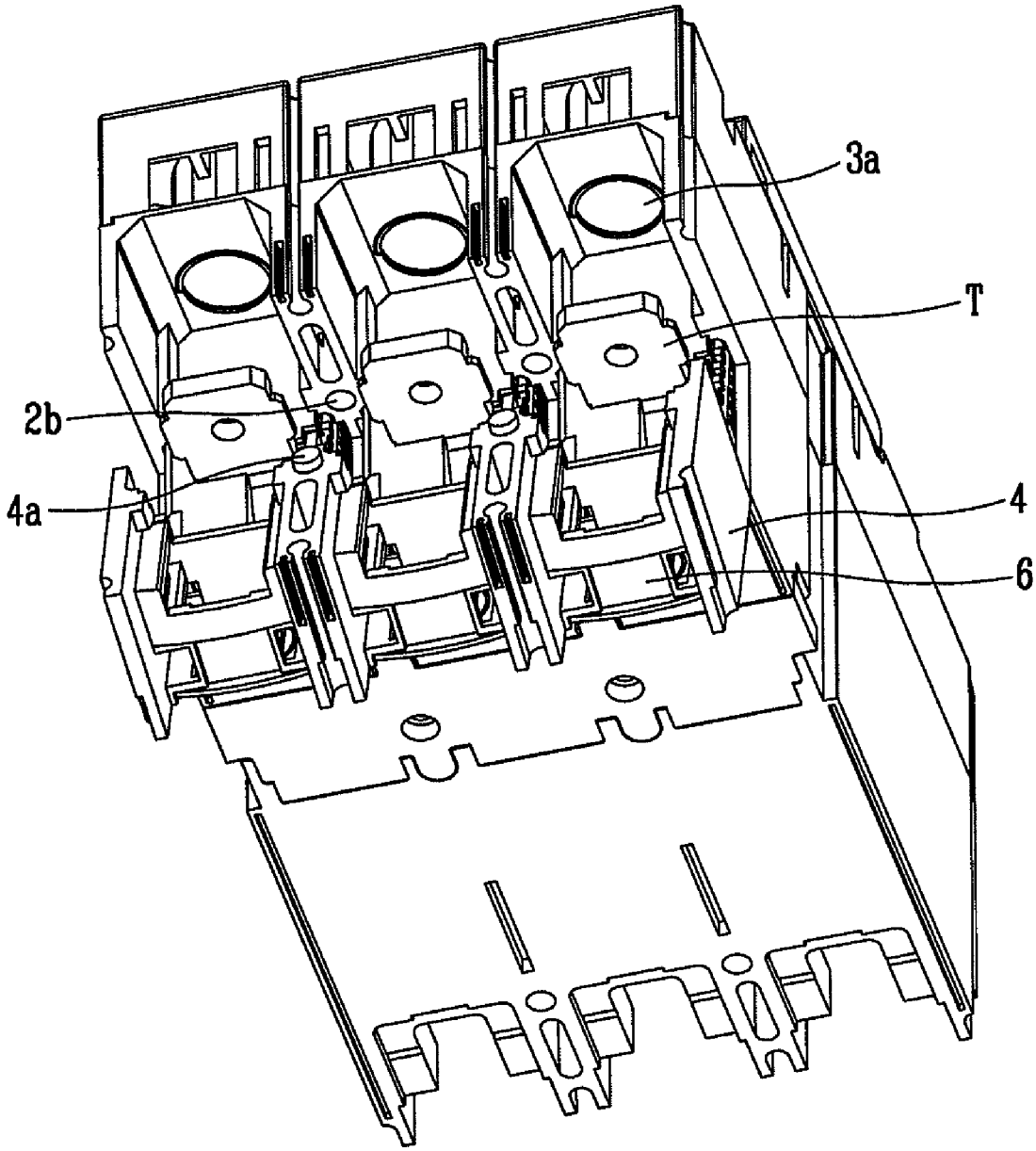
FIG. 17 is a perspective view shown from a lower side with an inclination angle illustrating a case for a circuit breaker having its door completely opened according to present invention.

FIG. 14 is a perspective view illustrating a case for a circuit breaker having its door completely opened according to present invention, FIG. 15 is a perspective view illustrating a case for a circuit breaker having a door half-opened or half-closed, and the view in the circle is an enlarged view of a engaging portion between the door and a lower case for the circuit breaker, FIG. 16 is a perspective view illustrating a case for a circuit breaker having a door completely closed according to the present invention, and FIG. 17 is a perspective view shown from a lower side with an inclination angle illustrating a case for a circuit breaker having its door completely opened according to present invention.

A case for a circuit breaker (hereinafter, referred to just 'case') with a terminal structure changeable monolithic door according to the present invention may include a lower case 2 (or case base portion), an upper cover 3, a terminal block portion 6 and a door 4.

The lower case 2 and the upper cover 3 may accommodate components for breaking a circuit.

Here, the components for breaking the circuit designate a movable contactor, a fixed contactor, a switching mechanism, a trip mechanism, an arc extinguishing mechanism, and the like, all of which are well known, and thus its explanation will be omitted.

The terminal block portion 6, as illustrated in FIGS. 16 and 17, has a structure formed in monolithic form with the cases 2 and 3, particularly, the door 4 in a molding manner.

Unlike in the related art that the terminal block has been separately fabricated to be assembled to the case, the terminal block portion 6 according to the present invention has a structure in which the terminal block portion 6 is formed in monolithic form with the lower case 2, particularly, with the door 4. Accordingly, an additional assembling process of the terminal block portion 6 may not be performed.

The terminal block portion 6, in another embodiment, may be formed in monolithic form with the lower case 2, other than formed in monolithic form with the door 4.

Here, the door 4 may only have insulating partition walls according to each pole and an engaging means with the lower case 2.

The terminal block portion 6 provides one common platform for plural types of terminals such as an upper connecting type terminal, a rear connecting-type terminal, a plug-in type terminal and a lug type terminal.

That is, the terminal block portion 6 may require no additional configuration for mounting such upper engaging type, rear connecting-type, plug-in type and lug type terminals thereto.

This operational effect will obviously be understood by the description to be provided later in which various types of terminals can be mounted with reference to FIGS. 18 to 21.

The door 4 is formed in monolithic form with the case 2 and 3, in more detail, with the lower case 2 by a molding. The door 4 may be operable to a closed position engaged with the lower case 2 and an opened position released from the lower case 2 in a state of having engaged to the lower case 2 in order to install a certain type of terminal selected from the plural types of terminals.

When the door 4 is opened, as shown in FIGS. 14, 15 and 17, a terminal portion T of a fixed contactor is exposed to the front surface of the circuit breaker 1 at its front, upper and lower surfaces and both lateral surfaces. Conversely, when the door 4 is closed, as shown in FIG. 17, the terminal portion T of the fixed contactor is exposed to the front surface of the circuit breaker 1 at its upper and front surfaces.

An unexplained reference numeral 2*a* in FIGS. 14 to 17 designates a concave portion for accommodating the door 4 and the terminal block portion 6, and 3*a* designates a driver insertion hole for coupling a coupling screw.

In the case according to the present invention previously described, the case 2 and 3, and more particularly, the lower case 2 and the door 4 are integrally configured. However, as shown in the circle of FIG. 15, at a connected part between the case and the door 4 is provided a hinge portion 5*a* thinner than the thickness of the case and the door 4 for serving as a hinge when opening or closing the door 4.

As shown in the circle of FIG. 15, in the case of the present invention, at the connected part between the case and the door 4 is further provided at least one reinforcing connector 5*b* having a thickness thicker than that of the hinge portion 5*a* for reinforcing the hinge portion 5*a*.

Three reinforcing connectors are configured in the exemplary embodiment.

These reinforcing connector 5*b* are provided in order to prevent the hinge portion 5*a* from being deteriorated and thereby damaged due to frequent opening/closing of the door 4.

In order to maintain the closed state by the engaging between case and the door 4, as shown in FIG. 17, the case 2 and 3, in more particular, the lower case 2 and the door 4 have engaging devices 2*b* and 4*a* at a position where they are engaged or disengaged each other.

The engaging devices 2*b* and 4*a* may include a engaging groove portion 2*b* installed at the case, namely, at the lower case 2, and a engaging protrusion 4*a* installed at the door 4 to be inserted into the engaging groove portion 2*b*, so as to maintain the engaging between the lower case 2 and the door 4, namely, to maintain the closed state when closing the door 4.

In addition, in the described embodiment as shown in FIG. 17, the engaging protrusion 4*a* is disposed at an upper portion of the door 4 and the engaging groove portion 2*b* is disposed at the corresponding position of the lower case 2 where the engaging protrusion 4*a* can be inserted. However, in a modified embodiment as shown in FIG. 14, the engaging groove portion (not designated as reference numeral in FIG. 14) is disposed at a rear surface of the door 4 and the engaging protrusion (not shown in FIG. 14) is disposed on a wall surface of the concave portion 2*a* or vice versa.

The engaging devices 2*b* and 4*a* may also be configured in another modified embodiment such that the engaging protrusion 4*a* is disposed at the lower case 2 and the engaging groove portion 2*b* in which the engaging protrusion 4*a* is inserted to maintain the engaging between the lower case 2 and the door 4 is disposed at the door 4.

The engaging devices 2*b* and 4*a* can also be configured in another embodiment such that a screw hole is disposed to be communicated with the door and the case, and a fixing screw is disposed to be inserted and coupled into the screw hole.

An operation of opening/closing the door of the case according to the present invention as shown in FIGS. 14 to 17 will be described as follows.

First, a door opening operation will be described.

In the closed state of the door 4 as shown in FIG. 16, when both lateral walls of the door 4 are grabbed by both hands to rotate the door 4 in a counterclockwise direction, the engaging protrusion 4*a* of the door 4 is separated from the engaging groove portion 2*b* of the lower case 2. Accordingly, the door 4 is partially opened as shown in FIG. 15 and then completely opened as shown in FIG. 14 or 17.

In the modified embodiment in which the engaging groove portion 2*b* is disposed at the rear surface of the door 4 and the engaging protrusion 4*a* is disposed at the wall surface of the concave portion 2*a*, or in the another modified embodiment in which the positions of the engaging groove portion 2*b* and the engaging protrusion 4*a* are switched to each other, the door 4 can be opened by being grabbed by both hands to be rotated in the counterclockwise direction as described above.

In the another embodiment in which the screw hole is disposed to be communicated with the door 4 and the case and the fixing screw is inserted into the screw hole to be screwed, first, the fixing screw is released and then the door 4 is rotated in a counterclockwise direction (in a direction to be opened) to thusly be opened.

A door closing operation will be described as follows.

In reverse order of opening the door 4, when the door 4 is completely opened as shown in FIG. 14 or 17, both lateral walls of the door 4 are grabbed by both hands to rotate the door 4 in the clockwise direction (i.e., toward the upper side of the drawing).

The lower portion of the door 4 is pressed upwardly such that the engaging protrusion 4*a* of the door 4 can be inserted into the engaging groove portion 2*b* of the lower case 2. Accordingly, the door 4 is partially closed as shown in FIG. 15, and then completely closed as shown in FIG. 16.

In the modified embodiment in which the engaging groove portion 2*b* is disposed at the rear surface of the door 4 and the engaging protrusion 4*a* is disposed at the wall surface of the concave portion 2*a*, or in the another modified embodiment in which the positions of the engaging groove portion 2*b* and the engaging protrusion 4*a* are switched to each other, the door 4 can be closed by being grabbed by both hands to be rotated in the clockwise direction as described above.

In the another embodiment in which the screw hole is disposed to be communicated with the door 4 and the case and the fixing screw is inserted into the screw hole to be screwed, first, the door 4 is rotated in a clockwise direction (in a direction to be closed) and then the fixing screw is tightened, thereby closing the door 4.

An operation of assembling various terminals to the case according to the present invention will be described with reference to FIGS. 18 to 21 as follows.

Figure 18:
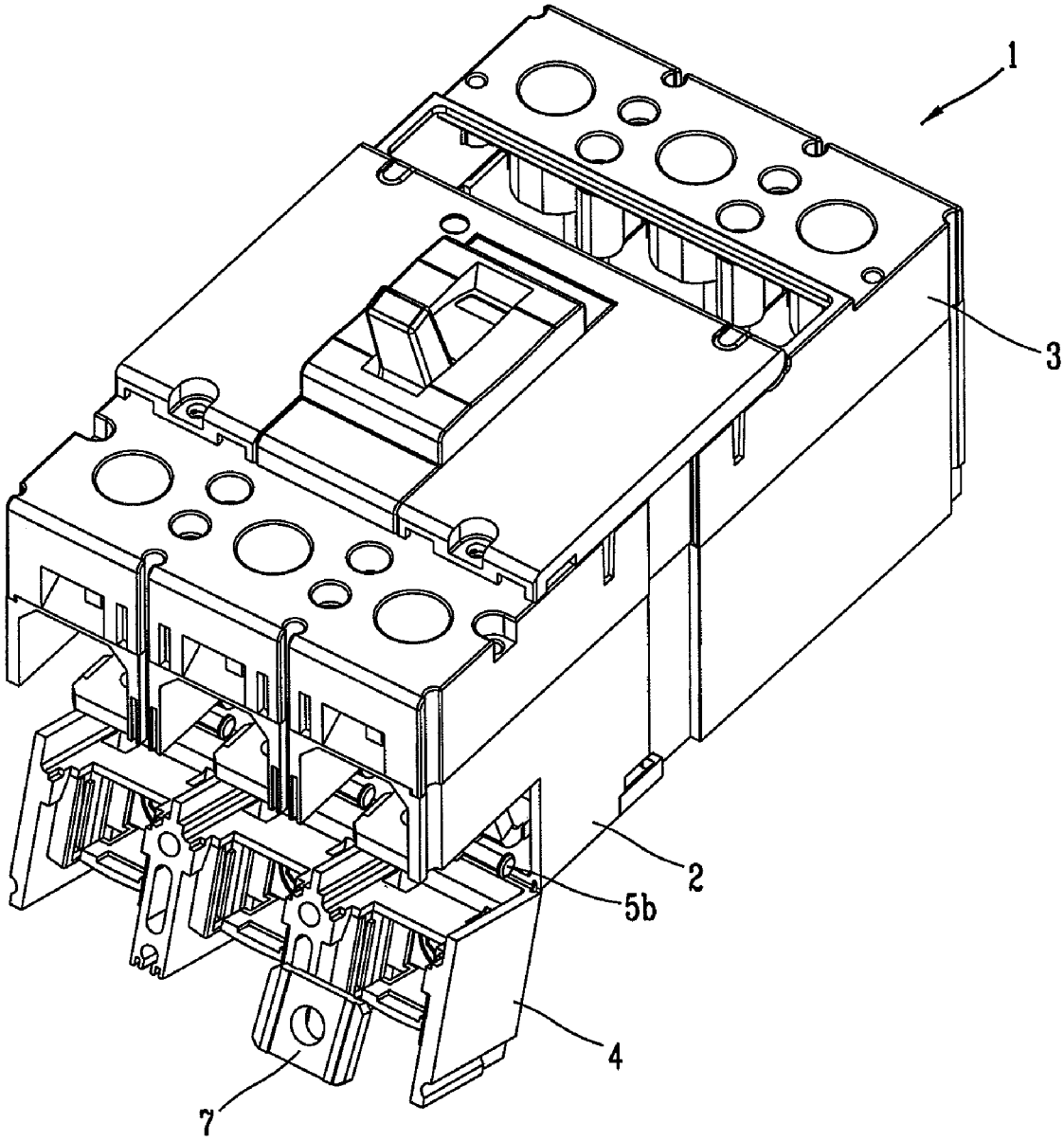
FIG. 18 is perspective view shown from an upper side with an inclination angle illustrating of a case for a circuit breaker having its door completely opened according to present invention, particularly, an operational state view of accommodating a nut for a standard type terminal.

FIG. 18 is a perspective view shown from an upper side with an inclination angle which illustrates a case for a circuit breaker having its door completely opened according to present invention, namely, an operational state view of receiving a nut for a standard type terminal.

Figure 19:
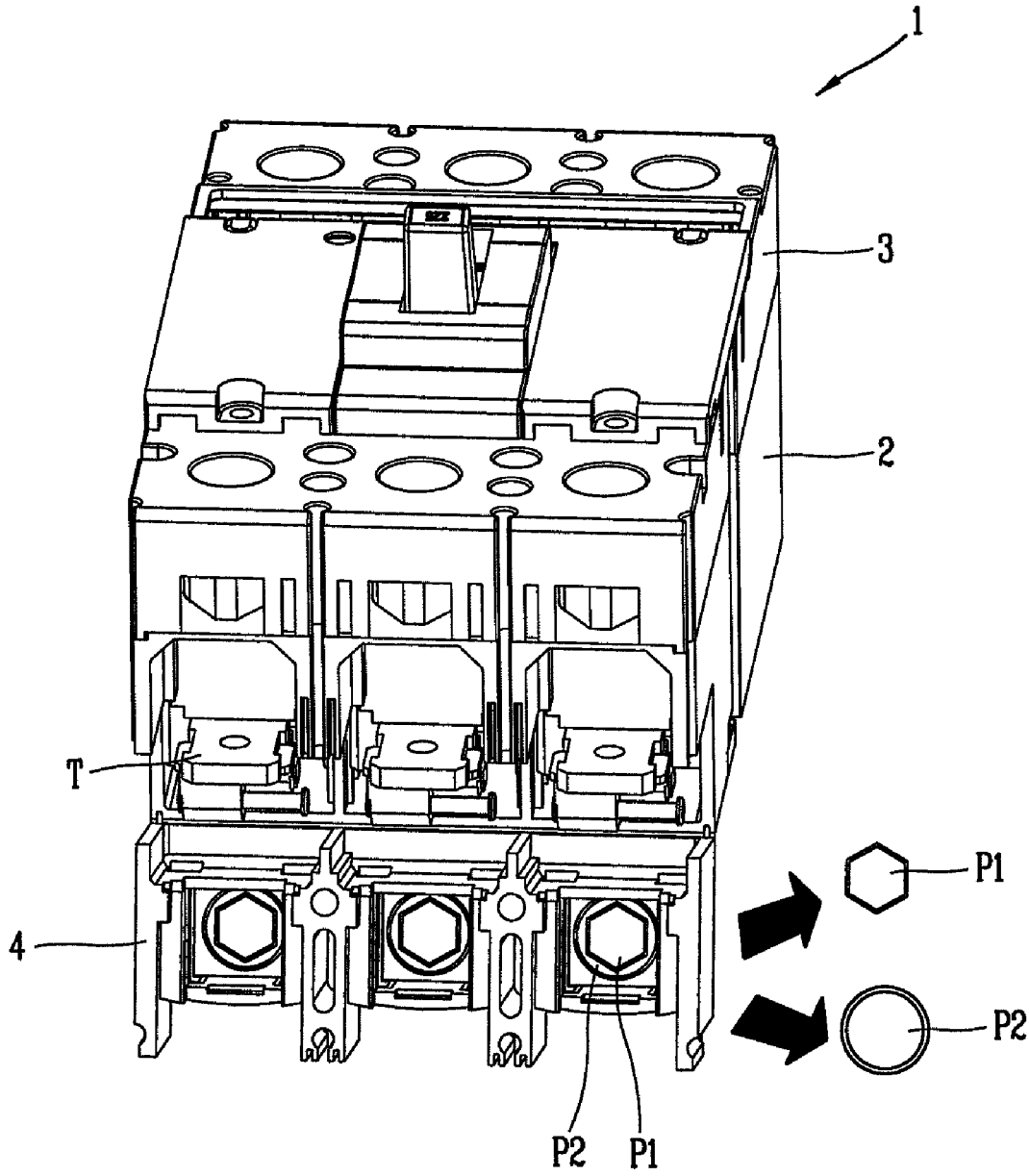
FIG. 19 is an operational state view illustrating that a door is opened to mount a rear connecting-type terminal or a plug-in type terminal and then a hexagonal or circular portion is removed in the door to insert a rear connecting or plug-in type terminal thereinto, in a case for a circuit breaker according to the present invention.

FIG. 19 is a state view illustrating an operation in which a door is opened to mount a rear connecting-type terminal or a plug-in type terminal and a hexagonal or circular portion is removed in the door to form insert a rear connecting or plug-in type terminal thereinto, in a case for a circuit breaker according to the present invention.

Figure 20:
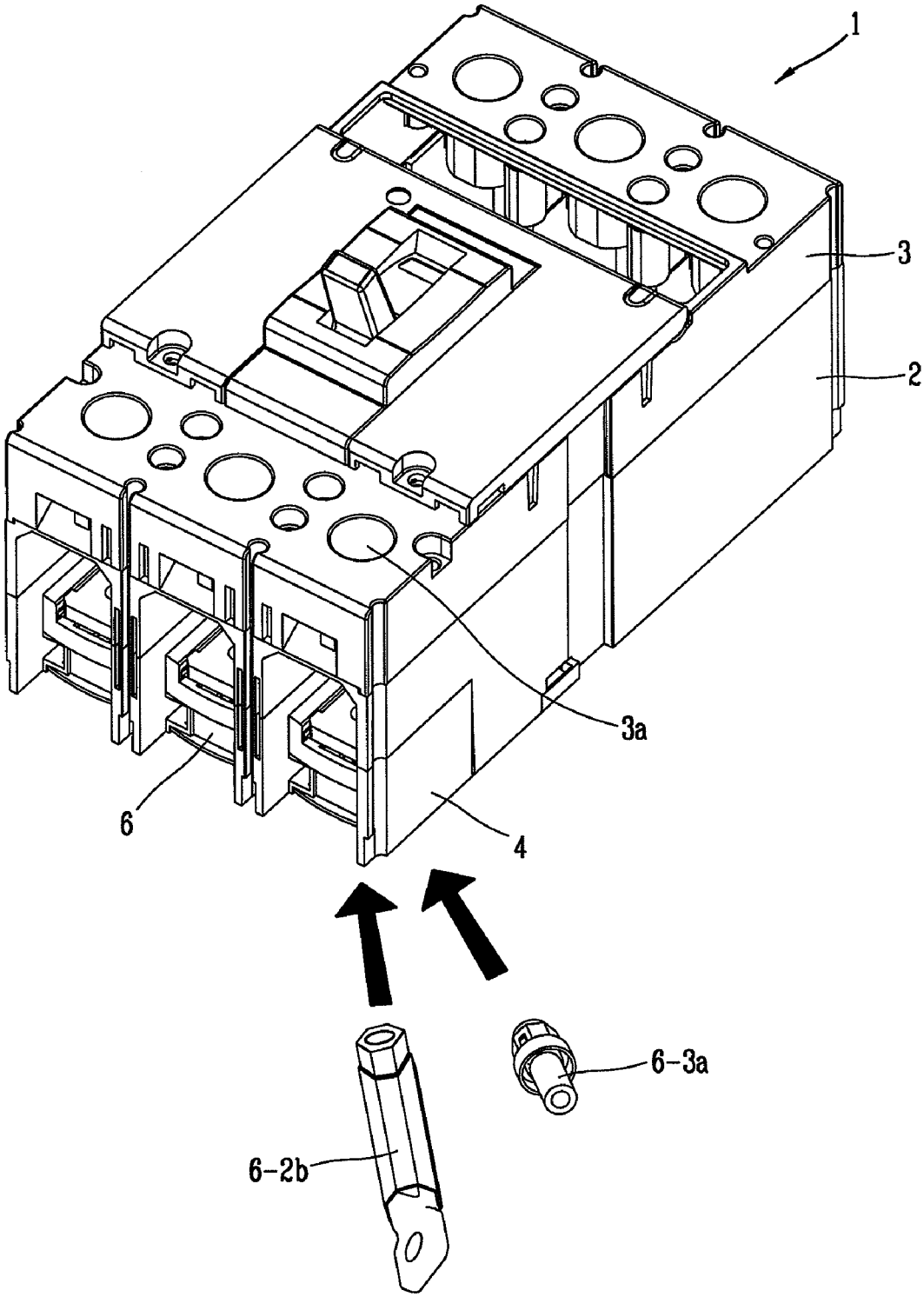
FIG. 20 is an operational state view illustrating an operation of upwardly inserting a rear connecting-type or plug-in type terminal after completely removing the hexagonal or circular portion to insert the terminal thereinto, in a case for a circuit breaker according to the present invention.
Figure 21:
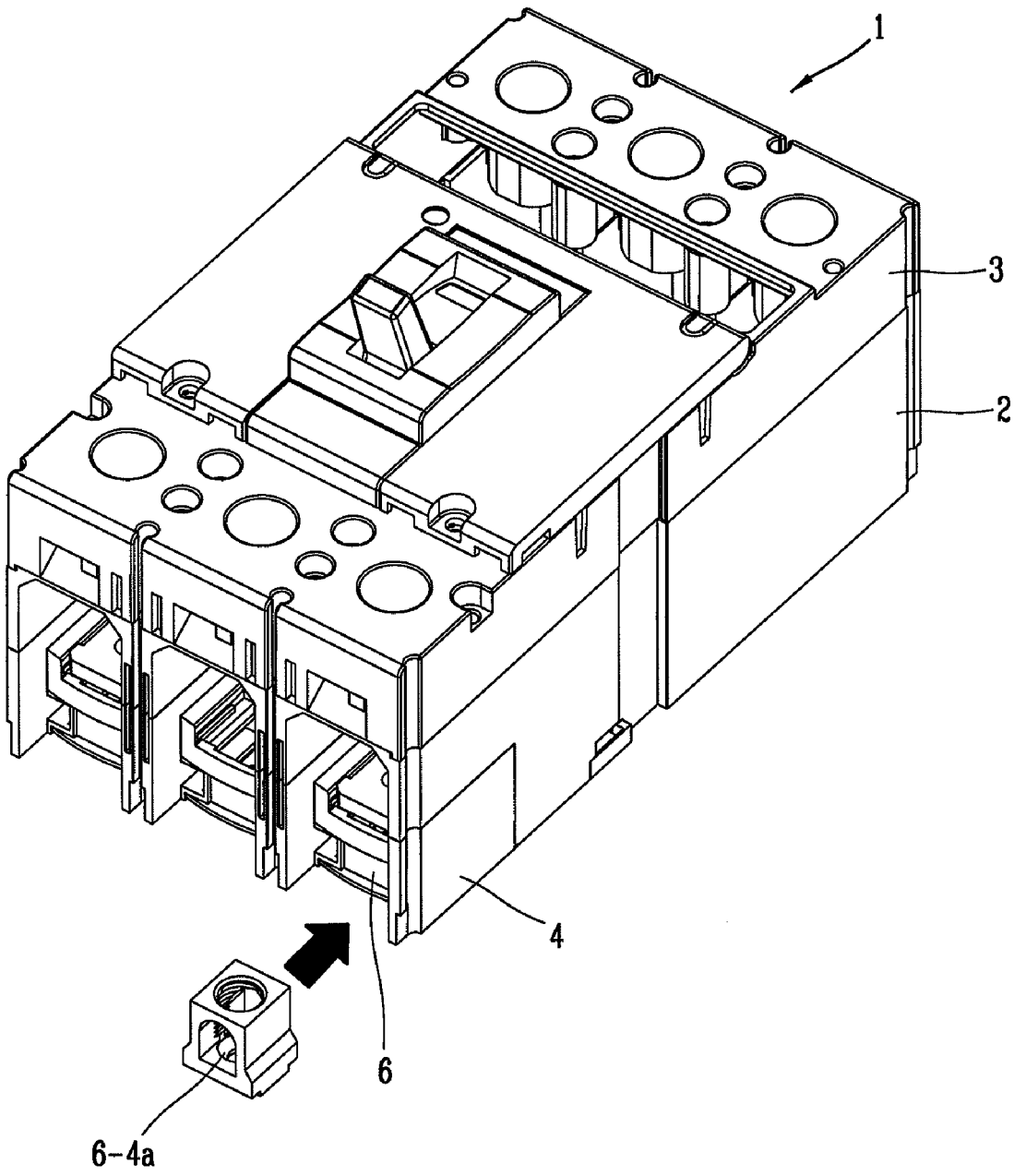
FIG. 21 is an operational state view illustrating an operation of mounting a lug in a case for a circuit breaker according to the present invention.

FIG. 20 is an operational state view illustrating an operation of upwardly inserting a rear connecting-type or plug-in type terminal after completely removing an insertion hole to insert the terminal thereinto, in a case for a circuit breaker according to the present invention, and FIG. 21 is an operational state view illustrating an operation of mounting a lug in a case for a circuit breaker according to the present invention.

First, an operation of installing a nut for a standard type terminal at the case according to the present invention will be described with reference to FIG. 18.

In the case of the present invention, a terminal block portion is formed in monolithic form with the door 4. Accordingly, an operation of assembling the terminal block according to each type of terminal like in the related art is not needed to be performed.

Thus, when installing the standard type terminal at the case of the present invention, only the nut 7 for the standard type terminal is pressed into the terminal block portion formed in monolithic form with the door 4, thereby completing the installation operation.

Figure 1:
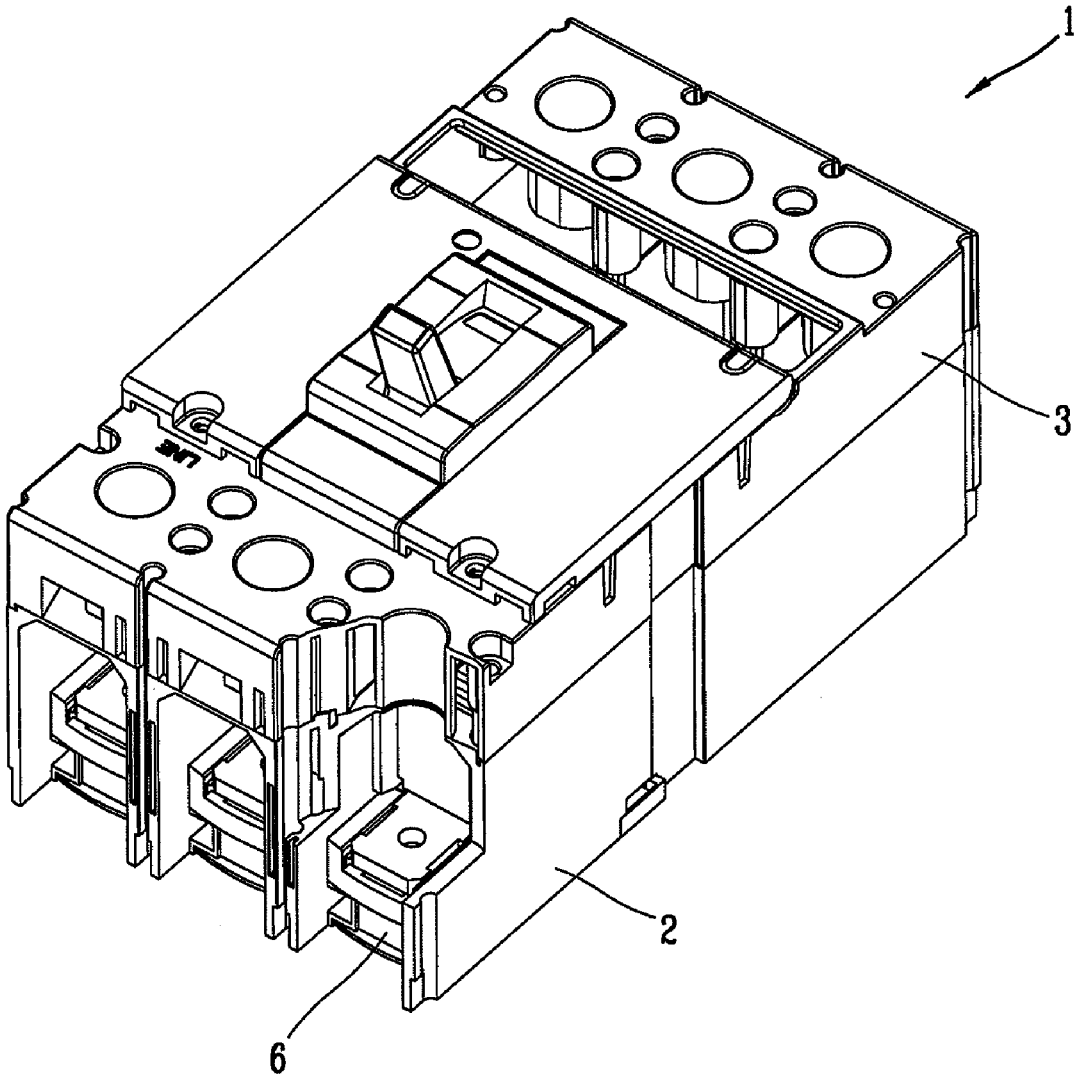
FIG. 1 RELATED ART
FIG. 1 is a perspective view illustrating a circuit breaker according to the related art and a case therefor, particularly, a partially-cut perspective view of a terminal portion.
Figure 2:
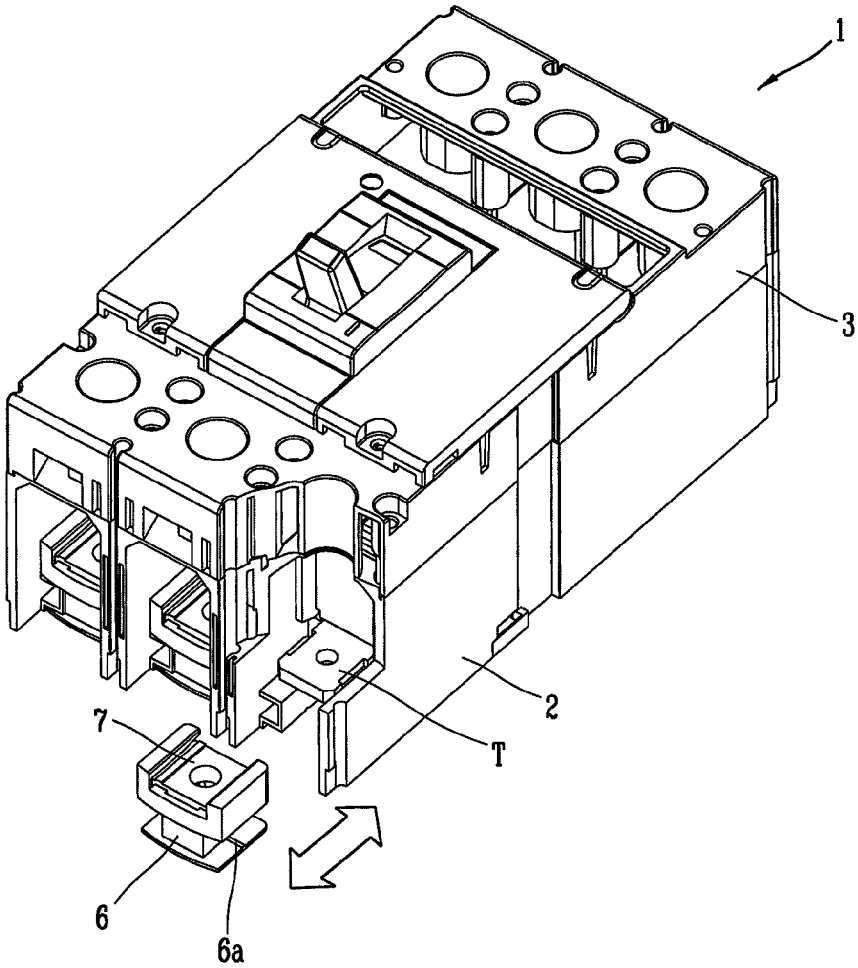
FIG. 2 RELATED ART
FIG. 2 is a view illustrating a circuit breaker according to the related art and a case therefor, particularly, an operational state view illustrating that a terminal block is assembled to or separated from a terminal portion.
Figure 3:
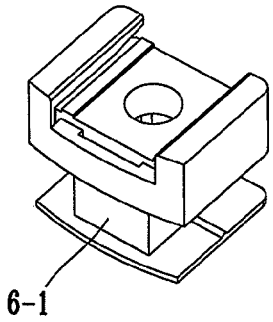
FIG. 3 RELATED ART
Figure 4:
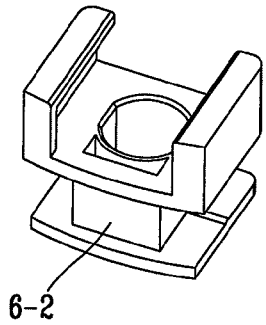
FIG. 4 RELATED ART
Figure 5:
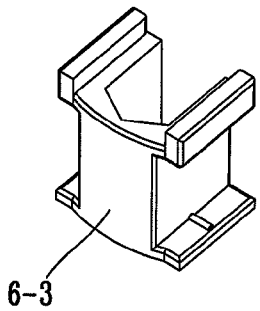
FIG. 5 RELATED ART
Figure 6:
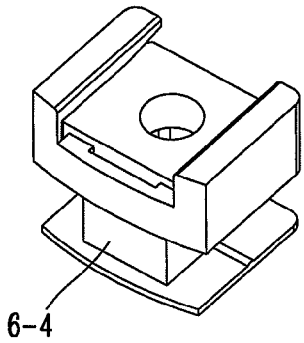
FIG. 6 RELATED ART
Figure 7:
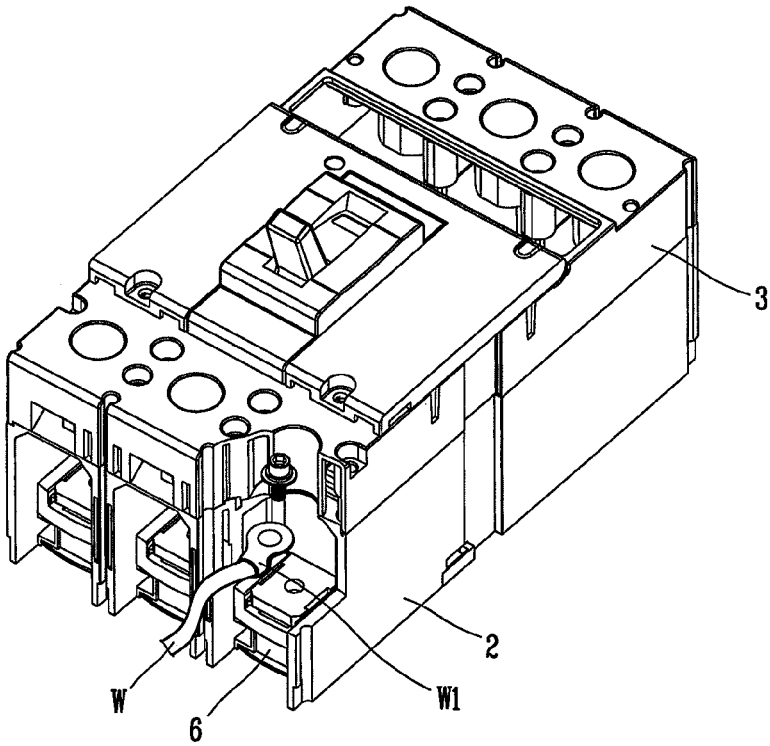
FIG. 7 RELATED ART
FIG.7 is a view illustrating a circuit breaker according to the related art and a case therefor, particularly, a state view illustrating an operation of engaging an external wire to a terminal portion having a standard type terminal block.
Figure 8:
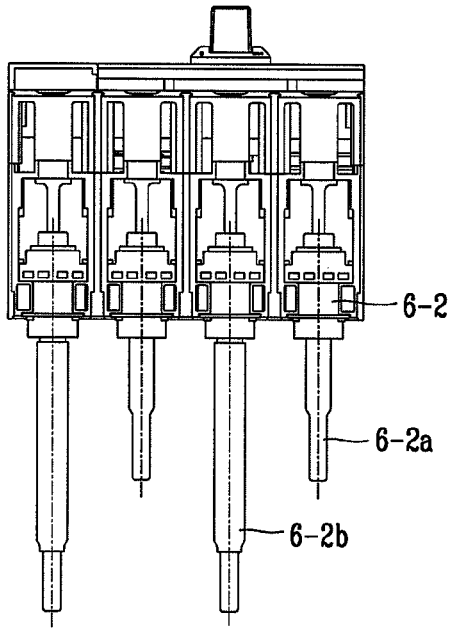
FIG. 8 RELATED ART
FIG. 8 is a view illustrating a circuit breaker according to the related art and a case therefor, particularly, a front view of a case for a circuit breaker according to the related art having a rear connecting-type terminal block mounted therein.

The operation of connecting an external wire to the standard type terminal is the same as that described in the related art with reference to FIG. 7, explanation of which will thusly be omitted.

Second, an operation of assembling a rear connecting-type terminal or a plug-in type terminal to the case of the present invention will be described with reference to FIGS. 19 and 20 as follows.

The case of the present invention characteristically has a portion relatively weaker than other portions on the bottom surface of the terminal block such that the weak portion can be removed to form an insertion hole in which the rear connecting-type terminal or plug-in type terminal is inserted.

The weak portion may be configured to be thinner than other portions on the bottom surface of the terminal block.

In another embodiment, the weak portion may be configured by punching a plurality of holes in correspondence with the shape of an edge of the insertion hole, thereby facilitating the removing.

In this state, the operations of assembling the rear connecting-type terminal or the plug-in type terminal to the case according to the present invention may include a first operation of forming an insertion hole to insert the rear connecting-type terminal or the plug-in type terminal therein, a second operation of upwardly inserting the rear connecting-type terminal or the plug-in type terminal into the insertion hole, and a third operation of fixing the inserted rear connecting-type terminal or plug-in type terminal by a screw.

The first operation is described with reference to FIG. 19. In case of an embodiment in which the weak portion is cut off by a knife or a plurality of holes are punched in correspondence with the shape of the edge of the insertion hole, the weak portion is hit by a driver, thereby removing a hexagonal portion P1 or a circular portion P2 as indicated by arrows, resulting in forming the insertion hole.

Then, as shown in FIG. 20, the second operation is performed by upwardly inserting the rear connecting-type terminal 6-2*b* or the plug-in type terminal 6-3*a* into the formed insertion hole.

The third operation is performed by coupling a coupling screw S (not shown) into a female screw formed at a head portion of the rear connecting-type terminal 6-2*b* or the plug-in type terminal 6-3*a* through a driver insertion hole 3*a*.

Figure 10:
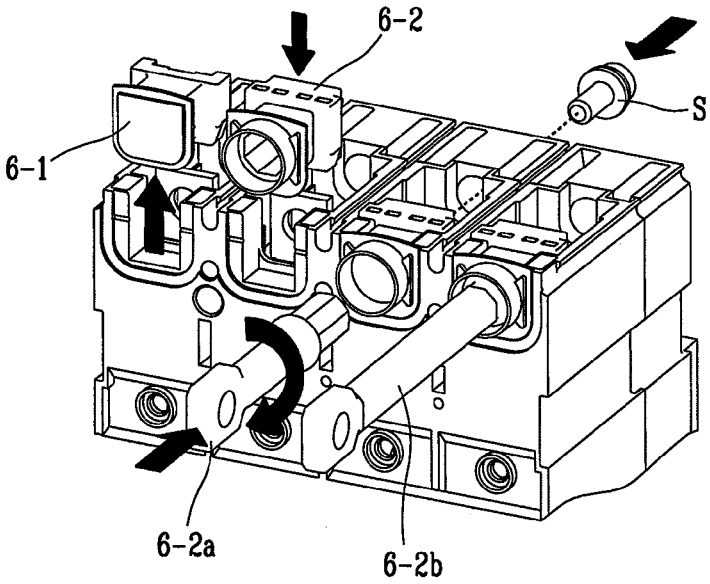
FIG. 10 RELATED ART
FIG. 10 is a view illustrating a circuit breaker according to the related art and a case therefor, particularly, a perspective view shown from a lower side of the circuit breaker with an inclination angle which illustrates an operation of first removing a standard type terminal block and mounting a rear connecting-type terminal block and a rear connecting-type terminal.
Figure 11:
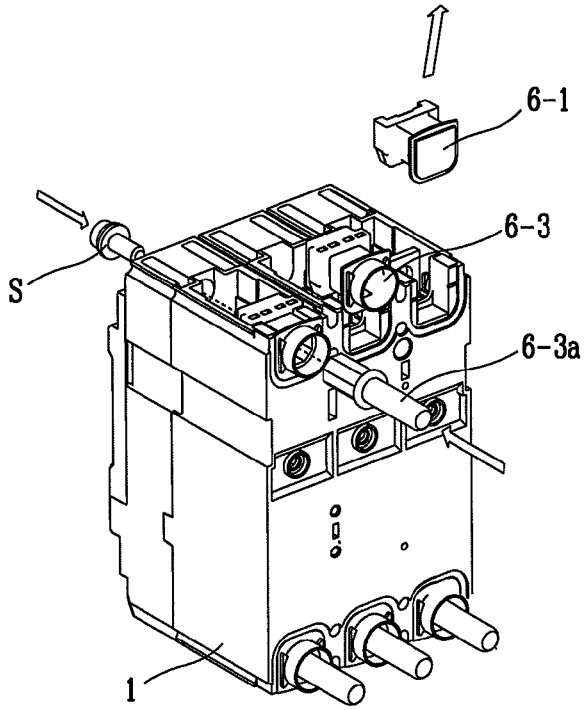
FIG. 11 RELATED ART
FIG. 11 is a view illustrating a circuit breaker according to the related art and a case therefor, particularly, a perspective view shown from a lower side of the circuit breaker with an inclination angle which illustrates an operation of first removing a plug-in type terminal block mounting a plug-in type terminal block and a plug-in type terminal.

The third operation is the same as the operation of fixing the rear connecting-type terminal or the plug-in type terminal according to the related art with reference to FIGS. 10 and 11. Accordingly, the description of the fixing operation will be referred.

Figure 9:
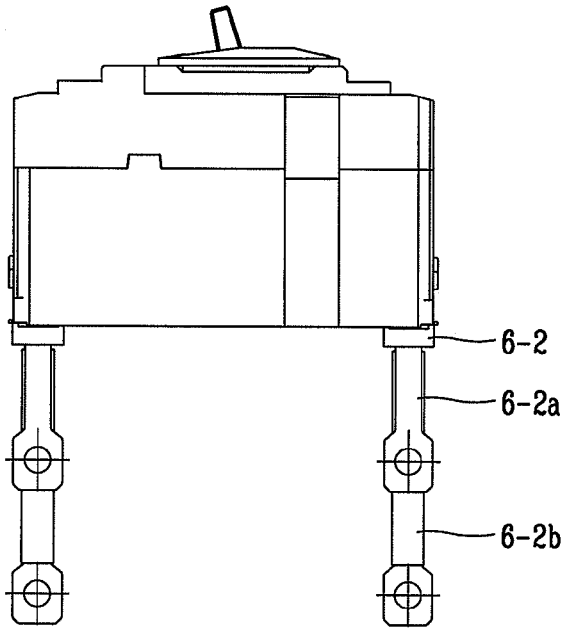
FIG. 9 RELATED ART
FIG. 9 is a view illustrating a circuit breaker according to the related art and a case therefor, particularly, a lateral view of the case for the circuit breaker according to the related art having a rear connecting-type terminal block mounted therein.

The operation of connecting an external wire to the rear connecting-type terminal can be understood by the previous description of the related art provided with reference to FIG. 9. The operation of connecting the plug-in type terminal to the plug-in connecting base can be understood by the previous description of the related art provided with reference to FIG. 12. Thus, the explanation of those operations will not be repeated.

Third, the operation of assembling the lug to the case according to the present invention will be described with reference to FIG. 21.

The operation of assembling the lug to the case according to the present invention can be performed as follows. In a state of the door 4 being closed without any additional configuration, the lug 6-4*a* is pressed into the terminal block portion 6 or pressed into a lug-exclusive nut (not shown) in a state that the lug-exclusive nut is mounted on the terminal block portion 6.

In order to change the wiring method, for example, an operation of replacing the lug type terminal of FIG. 21 with the low connecting-type terminal of FIG. 20 will be described.

Figure 12:
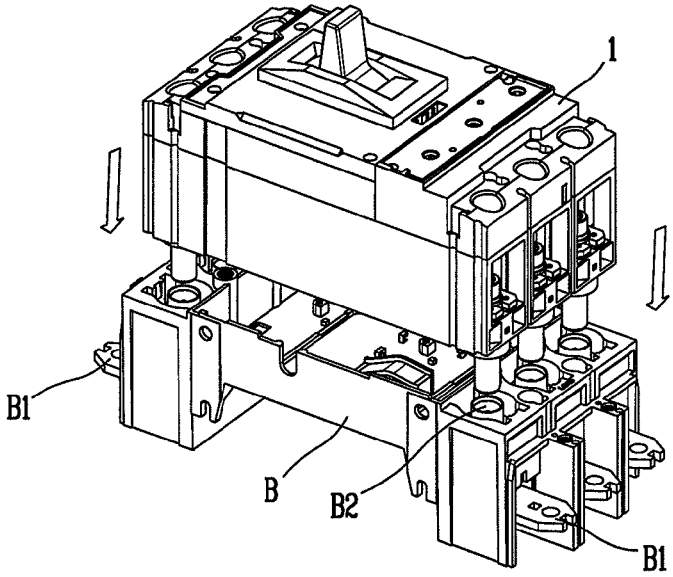
FIG. 12 RELATED ART
FIG. 12 is a state view illustrating an operation of connecting a circuit breaker having a plug-in type terminal block and a plug-in type terminal according to the related art and its case to a plug-in connecting base.
Figure 13:
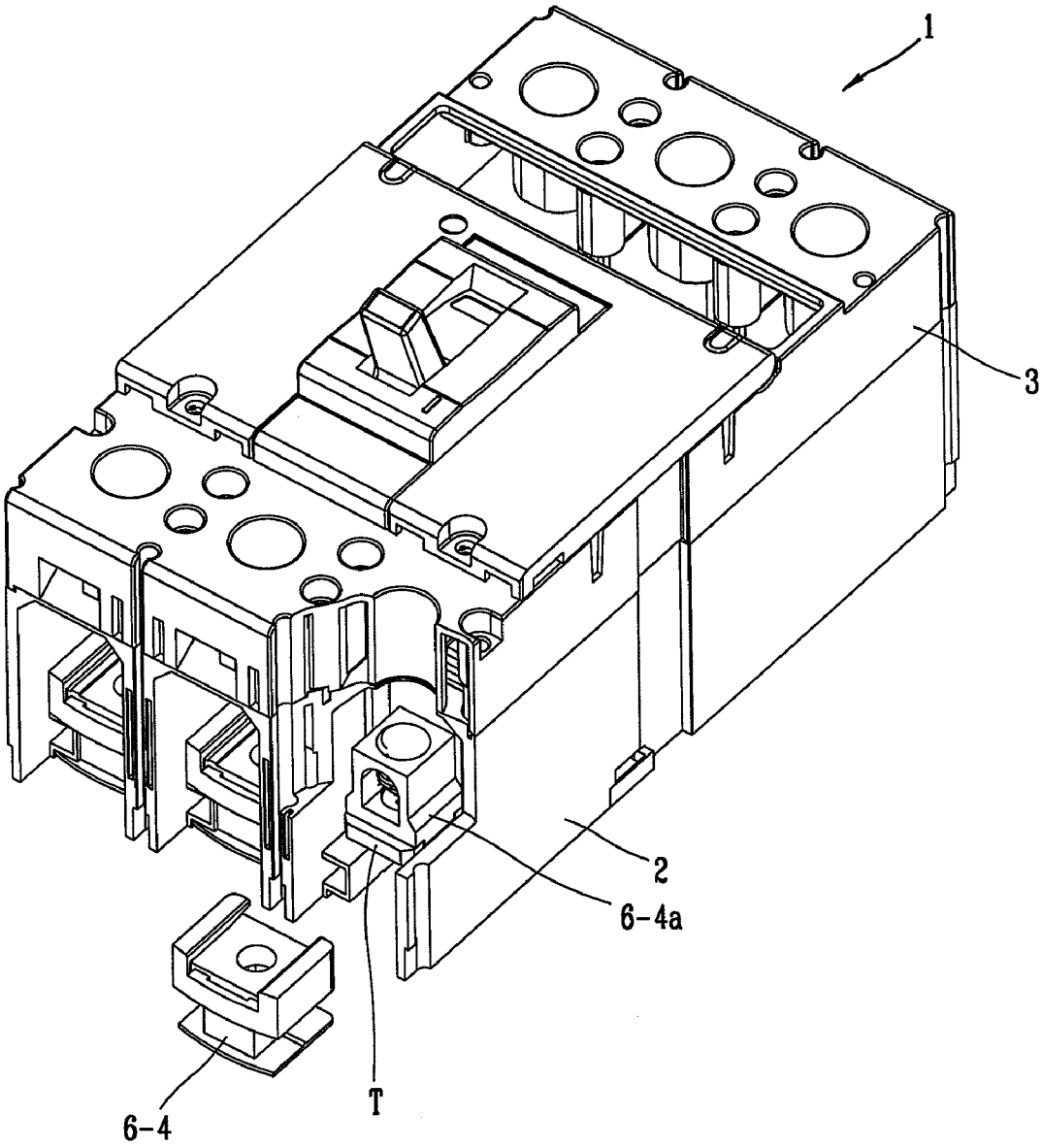
FIG. 13 RELATED ART
FIG. 13 is a view illustrating a circuit breaker according to the related art and a case therefor, particularly, a state view illustrating an operation of mounting a lug-type terminal block and a lug to the case.

Unlike in FIG. 12, the door 4 is opened to remove the lug by using tweezers, a driver, a hand or the like. In case that the lug-exclusive nut is mounted, the lug-exclusive nut is removed by using tweezers, a driver, a hand or the like. Afterwards, the rear connecting-type terminal is assembled according to the assembling method of the rear connecting-type terminal as shown in FIGS. 19 and 20 and then the door 4 is closed.

For example, in order to replace a standard type terminal with a plug-in type terminal for changing a wiring method, as shown in FIG. 18, the door 4 is opened to remove the mounted nut 7 by using tweezers, a driver, a hand or the like. Afterwards, the plug-in type terminal is assembled according to the assembling method of the plug-in type terminal as shown in FIGS. 19 and 20 and then the door 4 is closed.

In the case for the circuit breaker having the terminal structure changeable monolithic door according to the present invention, it is easy to get the portion required to be replaced by opening the door. Also, the target to be replaced, namely, the lug and the nut can easily be removed by gravity when opening the door. Since the terminal block portion is formed in monolithic form with the case or the door, the terminal block does not need to be replaced, thereby simplifying the overall process. In addition, the replacement of the terminal by the change in the wiring method can simply be done.

As described above, in the case for the circuit breaker having the terminal structure changeable monolithic door according to the present invention, since the terminal block is formed in monolithic form with the case or the door, manufacturers or installation operators of the circuit breaker do not have to keep various types of terminal blocks based upon wiring methods.

Also, in the case for the circuit breaker having the terminal structure changeable monolithic door according to the present invention, since the terminal block portion is formed in monolithic form with the case or the door, the terminal block can be prevented from its loss.

In addition, in the case for the circuit breaker having the terminal structure changeable monolithic door according to the present invention, since the terminal block portion is formed in monolithic form with the door engaged to the case or the terminal block portion is formed in monolithic form with the case, a nut or terminal can be replaced according to a required wiring method in order to change the wiring method, thereby simplifying the structure of the circuit breaker and the replacement method of the nut or terminal.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A case for a circuit breaker having a monolithic door, the case comprising:

a case base portion;

a terminal block portion that provides a common platform for plural types of terminals;

a door engaged with the case base portion in monolithic form so that it may be operable to a closed position for closing the case or an opened position for installing a selected terminal of the plural types of terminals; and a hinge portion that pivotably connects the door to the case base portion; and an engaging device disposed at an engaged portion where the case base portion and the door are engaged or disengaged, so as to maintain a closed state of the door by the engagement between the case base portion and the door, the engaging device comprising: an engaging groove portion which is disposed at one of the case base portion and the door; and an engaging protrusion which is disposed at the other of the case base portion and the door, wherein the engaging protrusion is inserted into the engaging groove to maintain the door in the closed state.

2. The case of claim 1, wherein the hinge portion is thinner than the case base portion and the door.

3. The case of claim 1, wherein the engaged portion between the case base portion and the door comprises:

the hinge portion, the hinge portion being thinner than the thickness of the case base portion and the door; and at least one reinforcing connector, which is thicker than the hinge portion to reinforce the hinge portion.

4. The case of claim 1, wherein the door is formed in monolithic form with the terminal block portion.

5. The case of claim 1, wherein the case base portion is formed in monolithic form with the terminal block portion.

6. The case of claim 1, wherein the terminal block portion has a portion weaker than other portions on a bottom surface of the terminal block so that the weak portion can be removed to form an insertion hole to insert a rear connecting-type terminal or a plug-in type terminal therein.

7. The case of claim 6, wherein the weak portion is formed to be thinner than the other portions on the bottom surface.

8. The case of claim 6, wherein the weak portion is formed by punching a plurality of holes in correspondence with the shape of an edge of the insertion hole to be easily removed.

* * * * *